US007270468B2

(12) United States Patent
Lin

(10) Patent No.: US 7,270,468 B2
(45) Date of Patent: Sep. 18, 2007

(54) LAMP STRING

(76) Inventor: Vincent Lin, No. 39, Sec. 3, Chung-Hua Rd., Hsin-Chu City (TW)

( * ) Notice: Subject to any disclaimer, the term of this patent is extended or adjusted under 35 U.S.C. 154(b) by 0 days.

(21) Appl. No.: 11/390,367

(22) Filed: Mar. 28, 2006

(65) Prior Publication Data

US 2007/0159822 A1 Jul. 12, 2007

(30) Foreign Application Priority Data

Jan. 6, 2006 (CN) ..... 2006 2 0003337

(51) Int. Cl.
*F21V 21/00* (2006.01)

(52) U.S. Cl. ..... 362/652; 362/655; 362/653; 362/249; 439/619; 439/699.2

(58) Field of Classification Search ..... 362/647, 362/653, 652, 654, 655, 656–659, 249, 396, 362/391, 806; 439/374, 619, 699.2, 611; 313/318.1, 318.09
See application file for complete search history.

(56) References Cited

U.S. PATENT DOCUMENTS 4,943,899 A * 7/1990 Tseng ..... 362/654
5,701,051 A * 12/1997 Lin ..... 313/318.1
6,066,004 A * 5/2000 Shen ..... 439/617
6,142,646 A * 11/2000 Liu ..... 362/652
6,257,740 B1 * 7/2001 Gibboney, Jr. ..... 362/288
6,774,549 B2 * 8/2004 Tsai et al. ..... 313/318.01
7,094,111 B1 * 8/2006 Qingbiao ..... 439/699.2
7,186,017 B2 * 3/2007 Kuo ..... 362/654

* cited by examiner

*Primary Examiner*—Thomas M. Sember
(74) *Attorney, Agent, or Firm*—Pillsbury Winthrop Shaw Pittman, LLP

(57) ABSTRACT

A lamp string includes bulb mounting units arranged electrically in series with each other, and light-emitting units, each provided with two conductive leads. Each bulb mounting unit includes: a receptacle formed with angularly displaced first and second inner shoulders, the first inner shoulder having a shorter depth than the second inner shoulder from a top open end of the receptacle; a mounting seat mounted in the receptacle and including a flange formed with an axially extending protrusion, the flange having a portion seated on the first inner shoulder, the axially extending protrusion being seated on the second inner shoulder; and first and second conductive contacts contacting the leads of a respective light-emitting unit.

7 Claims, 9 Drawing Sheets

LAMP STRING

CROSS-REFERENCE TO RELATED APPLICATION

This application claims priority of Chinese Application No. 200620003337.9, filed on Jan. 6, 2006.

BACKGROUND OF THE INVENTION

1. Field of the Invention

The invention relates to a lamp string, more particularly to a lamp string including bulb mounting units, each of which has parts with orienting means.

2. Description of the Related Art

In a festival or an occasion for presenting 1 a cheerful atmosphere, such as Christmas, a lamp string, especially one with many colored bulbs, is wound on an object to be decorated, such as a Christmas tree, for providing illumination during the night.

As shown in FIGS. 1, 2 and 3, a conventional decorative lamp string 1 includes a plurality of bulb units 2 arranged electrically in series with each other so as to form an electric current loop, and a plug 3 coupled electrically to the bulb units 2 and adapted for plugging into a power source. Each of the bulb units 2 includes a receptacle 21, a mounting seat 22 mounted in the receptacle 21, and a light-emitting diode 23 mounted on the mounting seat 22. The receptacle 21 provides a cathode conductive contact 211 and an anode conductive contact 212. The light-emitting diode 23 includes a cathode conductive lead 231 and an anode conductive lead 232. When the light-emitting diode 23 is mounted on the mounting seat 22, the cathode conductive lead 231 and the anode conductive lead 232 must be coupled electrically to the cathode conductive contact 211 and the anode conductive contact 212, respectively, so as to establish the electric current loop and so as to permit activation of the light-emitting diodes 23. To prevent the mounting seat 22 from being inserted in an incorrect orientation, the mounting seat 22 includes a pair of spaced apart triangular protrusions 221 extending radially from a housing thereof, and the receptacle 21 is formed with a pair of triangular grooves 213 conforming to the triangular protrusions 221, such that, when the mounting seat 22 is inserted into the receptacle 21, the triangular protrusions 221 must be aligned with the triangular grooves 213 so as to enable the triangular protrusions 221 to be fully extended into the triangular grooves 213.

However, since the mounting seat 22 is made of plastic material, forced insertion of the triangular protrusions 221 of the mounting seat 22 into the triangular grooves 213 of the receptacle 21 in an incorrect orientation can still happen, thereby damaging the structures of the mounting seat 22 and the receptacle 21, and thereby resulting in wrong polarity for the light emitting diodes 23.

SUMMARY OF THE INVENTION

Therefore, the object of the present invention is to provide a lamp string capable of overcoming the aforesaid drawback associated with the prior art.

Accordingly, a lamp string of the present invention comprises: a plurality of bulb mounting units arranged electrically in series with each other; and a plurality of light-emitting units mounted respectively on the bulb mounting units, each of the light-emitting units being provided with a pair of conductive leads. Each of the bulb mounting units includes a receptacle defining an inner space, having a top open end, and formed with angularly displaced first and second inner shoulders in the inner space. Each of the first and second inner shoulders has a depth from the top open end of the receptacle. The depth of the first inner shoulder is shorter than that of the second inner shoulder. Each of the bulb mounting units further includes spaced apart first and second conductive contacts mounted in the receptacle and disposed below the first and second inner shoulders, and a mounting seat mounted in the receptacle and including a tubular part with a bottom end, and a flange extending radially and outwardly from a peripheral edge of the bottom end of the tubular part and formed with an axially extending protrusion. The flange has a contact portion seated on the first inner shoulder. The axially extending protrusion is seated on the second inner shoulder. Each of the light-emitting units is mounted in the tubular part of the mounting seat of the respective one of the bulb mounting units. The leads of each of the light-emitting units extend through the bottom end of the tubular part of the mounting seat of the respective one of the bulb mounting units, and are connected electrically respectively to the first and second conductive contacts.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
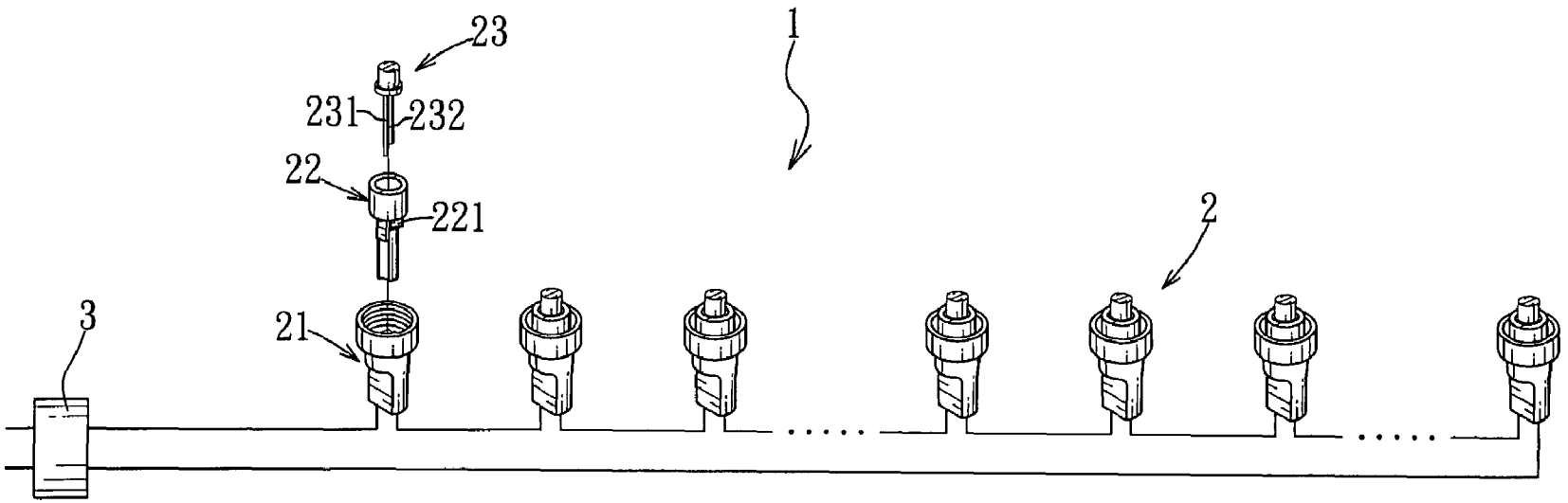
FIG. 1 PRIOR ART
FIG. 1 is a partly exploded perspective view of a conventional lamp string.
Figure 2:
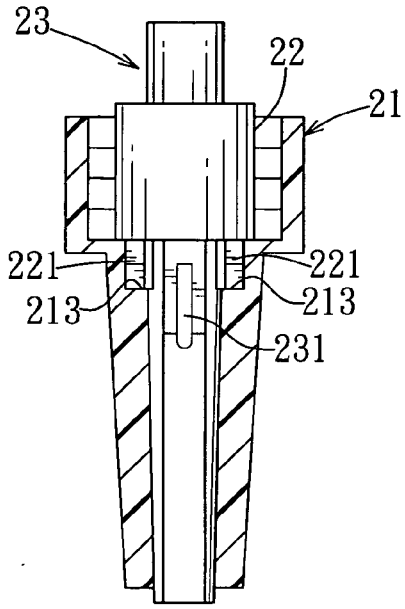
FIG. 2 PRIOR ART
FIG. 2 is an assembled sectional view of a bulb unit of the conventional lamp string.
Figure 3:
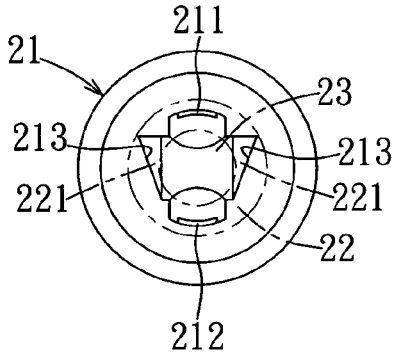
FIG. 3 PRIOR ART
FIG. 3 is a schematic top view of the bulb unit of the conventional lamp string.

Before the present invention is described in greater detail with reference to the accompanying preferred embodiments, it should be noted herein that like elements are denoted by the same reference numerals throughout the disclosure.

Figure 4:
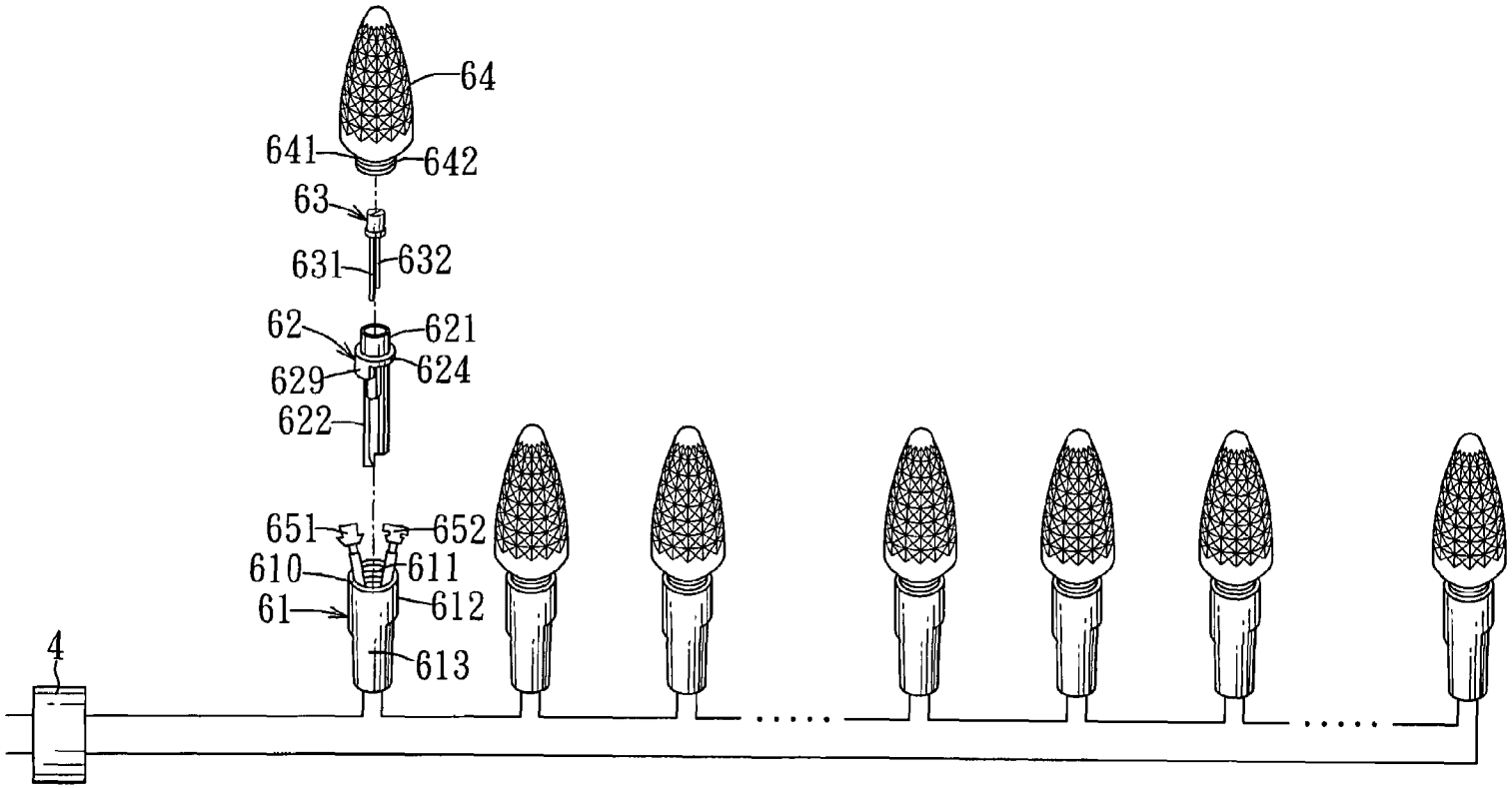
FIG. 4 is a partly exploded perspective view of the first preferred embodiment of a lamp string according to the present invention.
Figure 5:
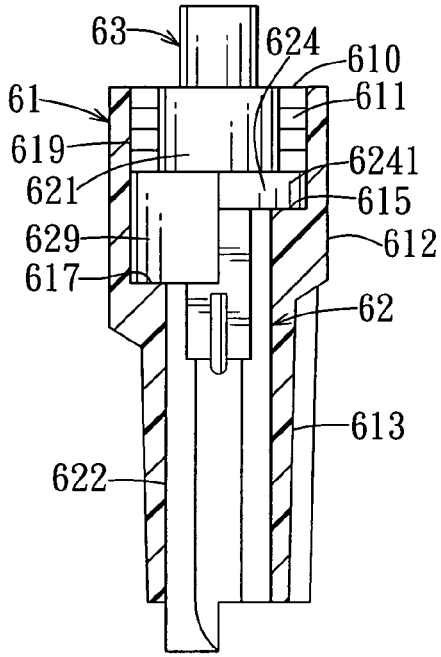
FIG. 5 is an assembled sectional view of a bulb unit of the first preferred embodiment for illustrating seating of a mounting seat in a receptacle.
Figure 6:
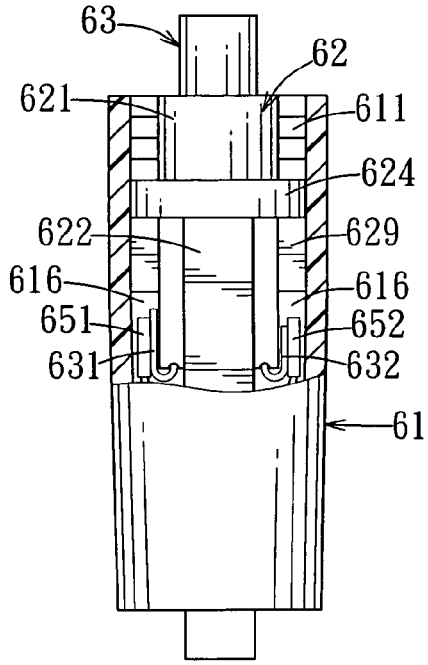
FIG. 6 is another assembled sectional view of the bulb unit of the first preferred embodiment for illustrating electrical connection between conductive contacts in the receptacle and conductive leads of a light-emitting diode.

Referring to FIGS. 4, 5 and 6, the first preferred embodiment of a lamp string 1 according to the present invention is shown to include: a plug 4; a plurality of bulb mounting units arranged together with the plug 4 electrically in series with each other; and a plurality of light-emitting units 63 mounted respectively on the bulb mounting units. Each of the light-emitting units 63 is provided with a pair of conductive leads 631, 632. Each of the bulb mounting units includes a receptacle 61 defining an inner space 619, having a top open end 610, and formed with angularly displaced first and second inner shoulders 615, 617 in the inner space 619. Each of the first and second inner shoulders 615, 617 has a depth from the top open end 610 of the receptacle 61. The depth of the first inner shoulder 615 is shorter than that of the second inner shoulder 617. Each of the bulb mounting units further includes spaced apart first and second conductive contacts 651, 652 mounted in the receptacle 61 and disposed below the first and second inner shoulders 615, 617, and a mounting seat 62 mounted in the receptacle 61 and including a tubular part 621 with a bottom end, and a flange 624 extending radially and outwardly from a peripheral edge of the bottom end of the tubular part 621 and formed with an axially extending protrusion 629. The flange 624 has a contact portion 6241 seated on the first inner shoulder 615. The axially extending protrusion 629 is seated on the second inner shoulder 617. Each of the light-emitting units 63 is mounted in the tubular part 621 of the mounting seat 62 of the respective one of the bulb mounting units. The leads 631, 632 of each of the light-emitting units 63 extend through the bottom end of the tubular part 621 of the mounting seat 62 of the respective one of the bulb mounting units, and are connected electrically and respectively to the first and second conductive contacts 651, 652.

In this embodiment, each of the light-emitting units 63 is an LED device. Each bulb mounting unit further includes a lamp shade 64 having a bottom portion 641 formed with an outer threaded segment 642. The receptacle 61 has a top section 612 formed with an inner threaded segment 611 engaging the outer threaded segment 642 such that the lamp shade 64 is detachably mounted on and cooperates with the receptacle 61 to enclose a respective one of the light-emitting units 63.

As best shown in FIG. 6, in this embodiment, the first and second conductive contacts 651, 652 differ from each other in shape, and are connected electrically and respectively to electric wires (not shown). The receptacle 61 is formed with two positioning grooves 616, each of which is configured to fit the shape of a respective one of the first and second conductive contacts 651, 652 so as to provide an orienting function for preventing the first and second conductive contacts 651, 652 from being inserted incorrectly in the receptacle 61.

Figure 7:
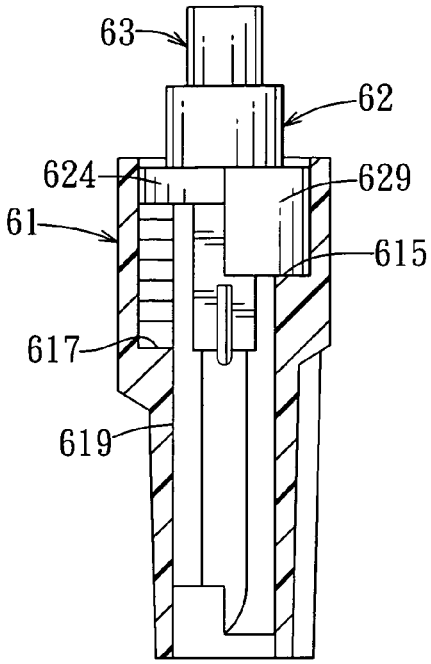
FIG. 7 is another sectional view of the bulb unit of the first preferred embodiment to illustrate the mounting seat when mounted incorrectly in the receptacle.

The receptacle 61 further has a neck section 613 extending downwardly from the top section 612. The mounting seat 62 has an anchoring part 622 extending downwardly from the tubular part 621 into the neck section 613 of the receptacle 61. As shown in FIG. 7, when the axially extending protrusion 629 is not aligned vertically with the second inner shoulder 617 but is aligned instead with the first inner shoulder 615, the axially extending protrusion 629 will abut against the first inner shoulder 615, and the mounting seat 62 cannot be moved further into the inner space 619 in the receptacle 61, thereby protecting the mounting seat 62 and the receptacle 61 from being damaged during assembly and preventing wrong polarity for the light emitting devices.

Figure 8:
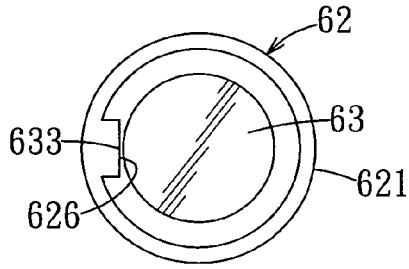
FIG. 8 is a schematic top view of the bulb unit of the first preferred embodiment to show engagement between an orienting protrusion of the mounting seat and an orienting groove in a housing of the light-emitting diode.

In this embodiment, as shown in FIG. 8, each of the light-emitting units 63 has a housing that is formed with an orienting groove 633, whereas the tubular part 621 of the mounting seat 62 of each of the bulb mounting units is formed with an inner orienting protrusion 626 that fits into the orienting groove 633 in the housing. of the respective one of the light-emitting units 63. Hence, when mounting each light-emitting unit 63 into the tubular part 621 of the mounting seat 62 of the respective one of the bulb mounting units, the orienting protrusion 626 has to be aligned with the orienting groove 633 so that the housing of the light-emitting unit 63 can be fully received in the tubular part 621 of the mounting seat 62 and so that the two conductive leads 631, 632 can extend through respective through-holes formed in the bottom end of the tubular part 621 of the mounting seat 62 and be bent inwardly and then upwardly in the inner space 619 to abut respectively against the first and second conductive contacts 651, 652, as best shown in FIG. 6.

Figure 9:
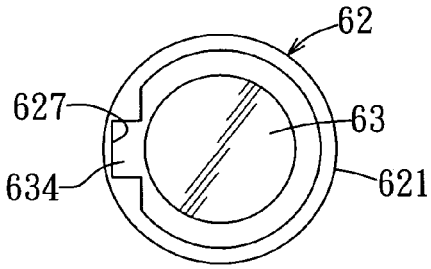
FIG. 9 is a schematic top view of the bulb unit of the second preferred embodiment to show engagement between an orienting protrusion of a housing of the light-emitting diode and an orienting groove of the mounting seat.

FIG. 9 illustrates a bulb unit of the second preferred embodiment of the lamp string according to this invention. The bulb unit of this embodiment differs from that of the previous embodiment in that the tubular part 621 of the mounting seat 62 of each of the bulb mounting units is formed with an inner orienting groove 627, whereas each of the light-emitting units 63 has a housing that is formed with a orienting protrusion 634 that protrudes outwardly therefrom and that fits into the inner orienting groove 627 in the tubular part 621 of the mounting seat 62 of the respective one of the bulb mounting units.

Figure 10:
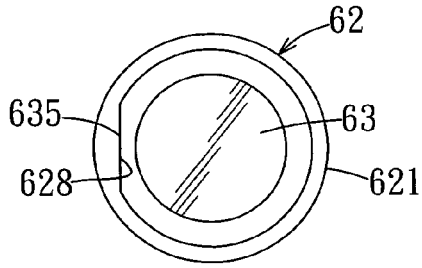
FIG. 10 is a schematic top view of the bulb unit of the third preferred embodiment to show engagement between a flat portion of a housing of the light-emitting diode and a flat portion of an inner wall of the mounting seat.

FIG. 10 illustrates a bulb unit of the third preferred embodiment of the lamp string according to this invention. The bulb unit of this embodiment differs from the first preferred embodiment in that the tubular part 621 of the mounting seat 62 of each of the bulb mounting units has an inner wall that has a flat portion 628, whereas each of the light-emitting units 63 has a housing that has a flat portion 635 conforming to the flat portion 628 of the inner wall of the tubular part 621 of the mounting seat 62 of the respective one of the bulb mounting units.

Figure 11:
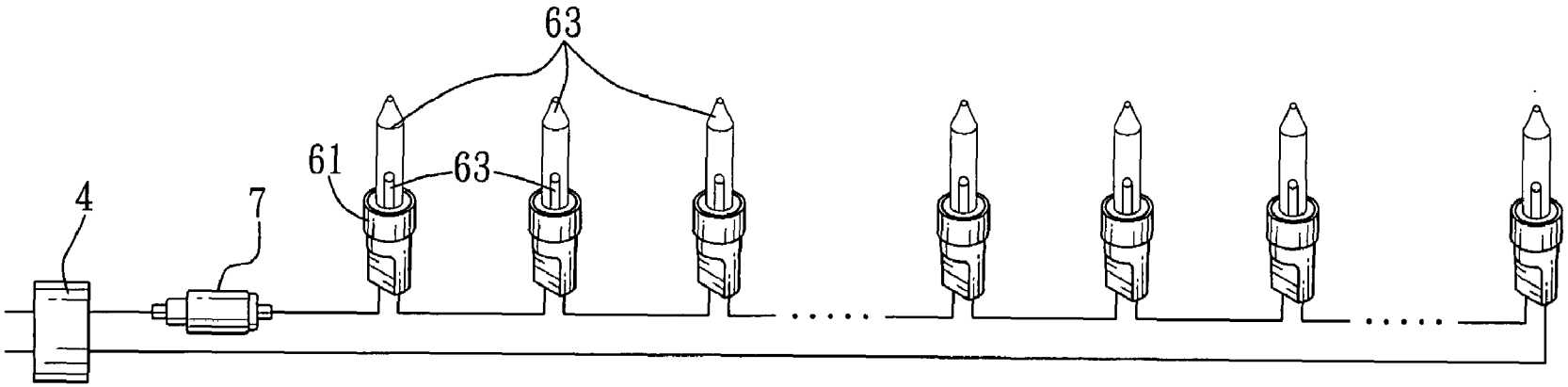
FIG. 11 is an assembled schematic view of the fourth preferred embodiment according to this invention.
Figure 12:
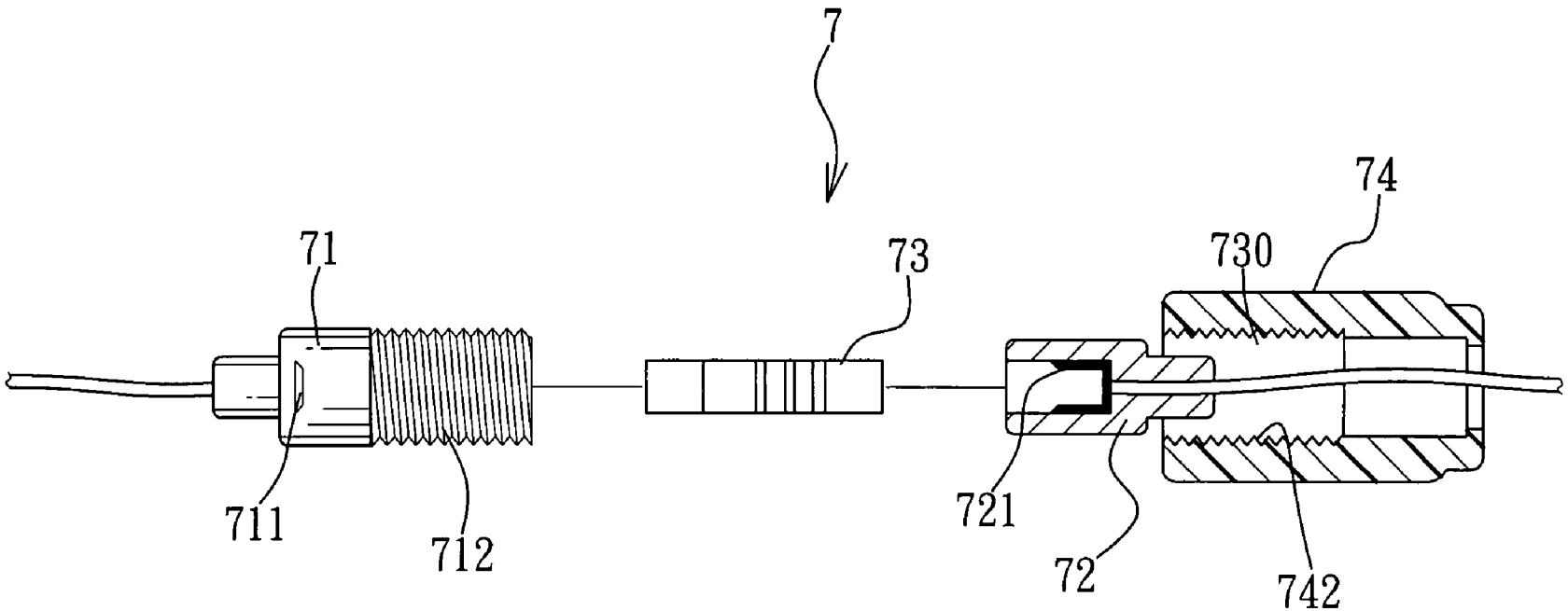
FIG. 12 is an exploded partly sectional view of an LED protecting unit of the fifth preferred embodiment.

FIGS. 11 and 12 illustrate the fourth preferred embodiment of the lamp string according to this invention. The lamp string of this embodiment differs from the first preferred embodiment in that this embodiment further includes an LED protecting unit 7. Since the light-emitting units 63 are light emitting diodes, which are highly sensitive to electric current, stability of current flowing therethrough is required. Hence, in order to achieve better protection, the lamp string further includes the LED protecting unit 7 in series connection with the bulb mounting units. The LED protecting unit 7 includes a first connector having a first housing 74 and a third conductive contact 721 mounted in the first housing 74 and connected electrically to an adjacent one of the bulb mounting units, and a second connector having a second housing 71 and a fourth conductive contact 711 mounted in the second housing 71 and connected electrically to a plug 4. The second housing 71 is detachably connected to the first housing 74 to define an enclosed space 730 therebetween. The third and fourth conductive contacts 721, 711 are exposed within the enclosed space 730. A resistor 73 is mounted in the enclosed space 730, and is connected electrically to the third and fourth conductive contacts 721, 711.

The second housing 71 has an outer threaded end 712, whereas the first housing 74 has an inner threaded end 742 that engages threadedly the outer threaded end 712 of the second housing 71. The first connector further includes a contact-mounting seat 72 that is mounted movably in the first housing 74 and that defines a recess for receiving the third conductive contact 721 therein. The resistor 73 has one contact end extending into the recess to contact the third conductive contact 721, and an opposite contact end contacting the fourth conductive contact 711. With the inclusion of the resistor 73, electrical current flowing in the electrical current loop of the lamp string can be controlled so as not to exceed a rated value and so as to protect the light-emitting units 63 from being burnt out.

Figure 13:
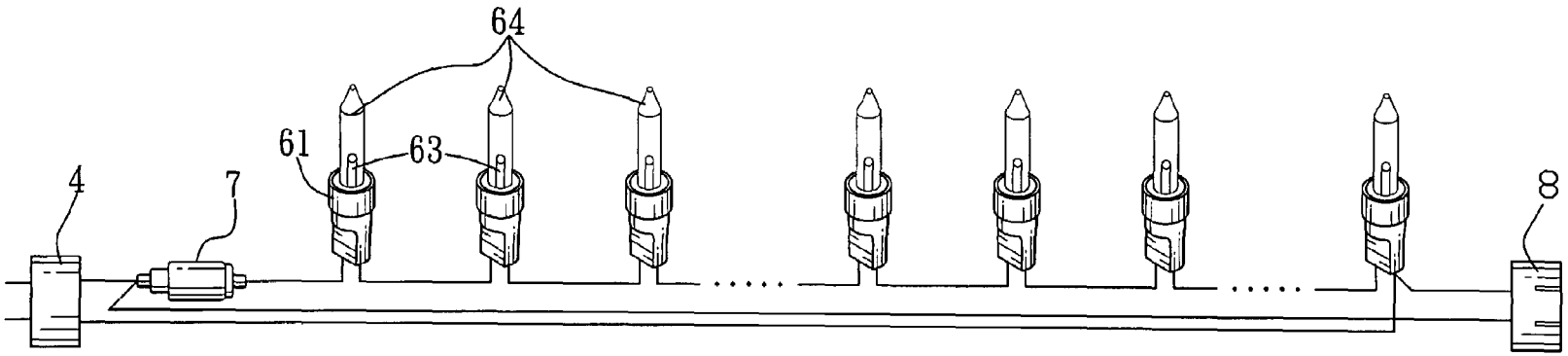
FIG. 13 is an assembled schematic view of the fifth preferred embodiment according to this invention.

FIG. 13 illustrates the fifth preferred embodiment of the lamp string according to this invention. The lamp string of this embodiment differs from the fourth preferred embodiment in that this embodiment further includes a socket 8 connected to the first connector and to one of the bulb mounting units that is most distal from the plug 4 for coupling electrically with another lamp string (not shown) in series connection.

Figure 14:
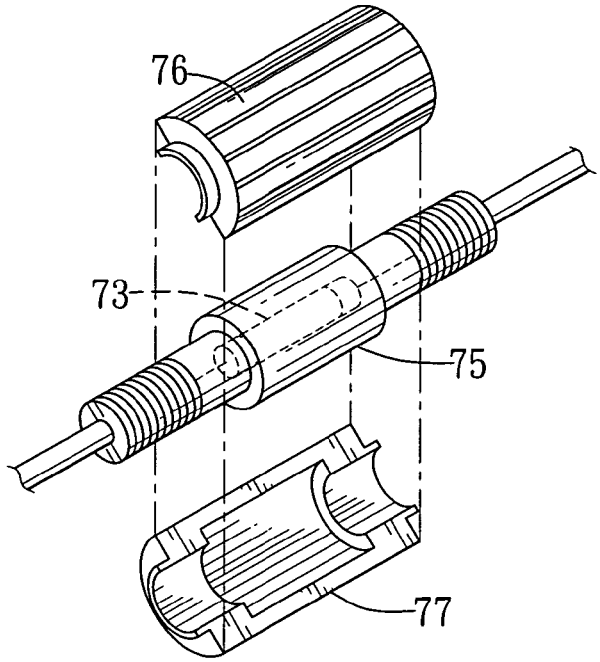
FIG. 14 is a partly exploded view of the LED protecting unit of the sixth preferred embodiment according to this invention.
Figure 15:
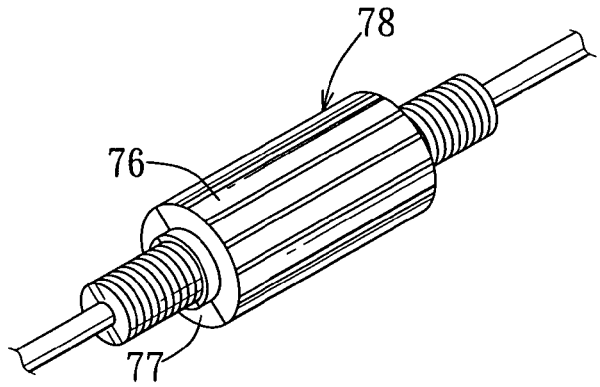
FIG. 15 is a fragmentary assembled view of the LED protecting unit of the sixth preferred embodiment.

FIGS. 14 and 15 illustrate an LED protecting unit of the sixth preferred embodiment of the lamp string according to this invention. In order to comply with the safety specification of U.S. Underwriters Laboratories Inc., which specifies all conductive components of electric apparatus should be totally shielded to avoid skin contact with a human body, the resistor 73 of the LED protecting unit is required to be enclosed by an insulative encapsulant 75 which can be made from plastic materials, such as PVC. A protective sleeve 78 is provided to enclose the encapsulant 75 for protecting the latter. As such, the protective sleeve 78 can be made from a plastic material that has higher resistance to chemical and severe weather conditions than that of the encapsulant 75. In order to facilitate manufacture of the LED protecting unit of this embodiment, the protective sleeve 78 is designed to include first and second halves 76, 77 that are detachably connected to each other.

With the inclusion of the flange 624 and the axially extending protrusion 629 in each mounting seat 62 and the first and second inner shoulders 615, 617 in each receptacle 61 of the lamp string of this invention, the aforesaid drawback associated with the prior art can be eliminated.

While the present invention has been described in connection with what is considered the most practical and preferred embodiments, it is understood that this invention is not limited to the disclosed embodiments but is intended to cover various arrangement included within the spirit and scope of the broadest interpretation so as to encompass all such modifications and equivalent arrangements.

What is claimed is:

1. A lamp string comprising:

a plurality of bulb mounting units arranged electrically in series with each other; and a plurality of light-emitting units mounted respectively on said bulb mounting units, each of said light-emitting units being provided with a pair of conductive leads;

wherein each of said bulb mounting units includes a receptacle defining an inner space, having a top open end, and formed with angularly displaced first and second inner shoulders in said inner space, each of said first and second inner shoulders having a depth from said top open end of said receptacle, the depth of said first inner shoulder being shorter than that of said second inner shoulder, spaced apart first and second conductive contacts mounted in said receptacle and disposed below said first and second inner shoulders, and a mounting seat mounted in said receptacle and including a tubular part with a bottom end, and a flange extending radially and outwardly from a peripheral edge of said bottom end of said tubular part and formed with an axially extending protrusion, said flange having a contact portion seated on said first inner shoulder, said axially extending protrusion being seated on said second inner shoulder; and wherein each of said light-emitting units is mounted in said tubular part of said mounting seat of the respective one of said bulb mounting units, said leads of each of said light-emitting units extending through said bottom end of said tubular part of said mounting seat of the respective one of said bulb mounting units and connected electrically and respectively to said first and second conductive contacts.

2. The lamp string as claimed in claim 1, wherein each of said light-emitting units is an LED device.

3. The lamp string as claimed in claim 1, wherein each of said light-emitting units has a housing that is formed with an orienting groove, said tubular part of said mounting seat of each of said bulb mounting units being formed with an inner orienting protrusion that fits into said orienting groove in said housing of the respective one of said light-emitting units.

4. The lamp string as claimed in claim 1, wherein said tubular part of said mounting seat of each of said bulb mounting units is formed with an inner orienting groove, each of said light-emitting units having a housing that is formed with an orienting protrusion that protrudes outwardly therefrom and that fits into said inner orienting groove in said tubular part of said mounting seat of the respective one of said bulb mounting units.

5. The lamp string as claimed in claim 1, wherein said tubular part of said mounting seat of each of said bulb mounting units has an inner wall that has a flat portion, each of said light-emitting units having a housing that has a flat portion conforming to said flat portion of said inner wall of said tubular part of said mounting seat of the respective one of said bulb mounting units.

6. The lamp string as claimed in claim 1, further comprising a plug and a protecting unit in series connection with said bulb mounting units and including a first connector having a first housing and a third conductive contact mounted in said first housing and connected electrically to an adjacent one of said bulb mounting units, a second connector having a second housing and a fourth conductive contact mounted in said second housing and connected electrically to said plug, said second housing being detachably connected to said first housing to define an enclosed space therebetween, said third and fourth conductive contacts being exposed within said enclosed space, and a resistor mounted in said enclosed space and connected electrically to said third and fourth conductive contacts.

7. The lamp string as claimed in claim 1, further comprising a plug and a protecting unit in series connection with said bulb mounting units and including a resistor that is connected to said plug and an adjacent one of said bulb mounting units, an encapsulant that encloses said resistor, and a protective sleeve that encloses said encapsulant and that includes first and second halves that are detachably connected to each other.

* * * * *